US007507885B2

(12) United States Patent
Coke

(10) Patent No.: US 7,507,885 B2
(45) Date of Patent: Mar. 24, 2009

(54) STRUCTURE FOR MUSICAL INSTRUMENT BODY

(76) Inventor: David A. Coke, 2898 Carpenter Ct., Commerce Township, MI (US) 48390

( * ) Notice: Subject to any disclaimer, the term of this patent is extended or adjusted under 35 U.S.C. 154(b) by 0 days.

(21) Appl. No.: 11/678,278

(22) Filed: Feb. 23, 2007

(65) Prior Publication Data

US 2008/0202310 A1 Aug. 28, 2008

(51) Int. Cl.
*G10D 3/00* (2006.01)

(52) U.S. Cl. ..... 84/291; 84/290; 84/267; 84/275

(58) Field of Classification Search ..... 84/267, 84/290, 291, 275, 277
See application file for complete search history.

(56) References Cited

U.S. PATENT DOCUMENTS

| | | | | | |
|---|---|---|---|---|---|
| 8,338 | A | * | 9/1851 | Tilton | 84/275 |
| 607,359 | A | | 7/1898 | Forrest | |
| 653,521 | A | | 7/1900 | Montoya | |
| 906,612 | A | * | 12/1908 | Cayton | 84/291 |
| 1,426,852 | A | | 8/1922 | Frozeth | |
| 1,788,745 | A | * | 1/1931 | Rowland | 84/276 |
| 1,889,408 | A | | 11/1932 | Larson | |
| 1,890,861 | A | * | 12/1932 | Overton | 84/267 |
| 1,897,531 | A | * | 2/1933 | Pasko | 84/277 |
| 2,204,150 | A | | 6/1940 | Quattrociocche | |
| 2,485,158 | A | * | 10/1949 | Lower | 84/275 |
| 2,660,912 | A | | 12/1953 | Prescott | |
| 2,837,953 | A | * | 6/1958 | Baschet | 84/275 |
| 2,977,835 | A | * | 4/1961 | Hornseth | 84/275 |
| 3,302,507 | A | | 2/1967 | Fender | |
| 3,523,479 | A | | 8/1970 | Ludwig | |
| 3,974,730 | A | | 8/1976 | Adams, Jr. | |
| 3,981,219 | A | * | 9/1976 | Johns | 84/275 |
| 4,026,181 | A | * | 5/1977 | Barcus et al. | 84/291 |
| 4,206,678 | A | * | 6/1980 | Espinos Guerrero | 84/267 |
| 4,253,371 | A | * | 3/1981 | Guice | 84/267 |
| 4,295,403 | A | | 10/1981 | Harris | |
| 4,512,231 | A | | 4/1985 | Mink | |
| 4,741,238 | A | | 5/1988 | Carriveau | |
| 5,052,269 | A | * | 10/1991 | Young, Jr. | 84/728 |
| 5,058,479 | A | | 10/1991 | Shaw | |
| 5,339,718 | A | | 8/1994 | Leduc | |
| 5,347,904 | A | * | 9/1994 | Lawrence | 84/291 |
| 5,567,896 | A | | 10/1996 | Gottschall | |
| 5,578,774 | A | * | 11/1996 | Dickson, II | 84/269 |
| 5,661,252 | A | * | 8/1997 | Krawczak | 84/291 |
| 5,895,872 | A | | 4/1999 | Chase | |
| 5,918,299 | A | * | 6/1999 | Yui | 84/291 |

(Continued)

*Primary Examiner*—Walter Benson
*Assistant Examiner*—Robert W Horn
(74) *Attorney, Agent, or Firm*—Burgess Law Office PLLC

(57) ABSTRACT

A structure for a musical instrument body that limits vibration of various components or parts of the body while controlling and providing for overall resonance of the instrument. The structure is suitable for use with a musical instrument, specifically an electric guitar. The structure includes a support member or block positioned in a chamber created between a top plate and bottom plate of the guitar body and a structural element, spaced from the top and bottom plates, that engages the block to provide additional support and stiffness enabling further control of the overall vibration and thus resonance of the instrument. Varying the design of the structure along with the various body components provides an apparatus for uniquely tuning the acoustic characteristics of the guitar body.

20 Claims, 4 Drawing Sheets

U.S. PATENT DOCUMENTS

| | | | | |
|---|---|---|---|---|
| 5,922,979 | A * | 7/1999 | Yui | 84/291 |
| 6,114,616 | A * | 9/2000 | Naylor | 84/291 |
| 6,255,567 | B1 * | 7/2001 | Minakuchi | 84/291 |
| 6,372,970 | B1 | 4/2002 | Saunders, Jr. et al. | |
| 6,459,024 | B1 * | 10/2002 | Baker | 84/291 |
| 6,646,189 | B2 * | 11/2003 | Minakuchi | 84/291 |
| 6,646,191 | B1 * | 11/2003 | Martin | 84/291 |
| 6,657,111 | B2 * | 12/2003 | Minakuchi | 84/291 |
| 7,002,065 | B2 * | 2/2006 | Petersen | 84/290 |
| 2005/0076764 | A1 | 4/2005 | Davis | |
| 2005/0211052 | A1 * | 9/2005 | Gigliotti | 84/290 |
| 2007/0144327 | A1 * | 6/2007 | Wyman | 84/267 |
| 2007/0234872 | A1 * | 10/2007 | Cody | 84/291 |
| 2008/0190263 | A1 * | 8/2008 | Drew | 84/291 |
| 2008/0202310 | A1 * | 8/2008 | Coke | 84/291 |

* cited by examiner

STRUCTURE FOR MUSICAL INSTRUMENT BODY

CROSS-REFERENCE TO RELATED APPLICATIONS

Not Applicable.

BACKGROUND OF THE INVENTION

1. Field of the Invention

The present invention relates generally to a musical instrument; and more specifically, to a support structure for a string instrument.

2. Description of Related Art

String instruments are centuries old. Such instruments typically use a sound box, fretted neck and strings stretched taunt across or over the sound box whereby strumming or plucking the strings causes them to vibrate and create a sound. Depressing a string against the fretted neck changes the effective length of the string, which in turn changes the frequency at which the string vibrates when plucked. One type of such a string instrument is a guitar. Today's guitars create sound either mechanically or electronically, forming two categories of guitar; acoustic, using mechanical amplification or electric, using electronic amplification.

With an acoustic guitar, plucking the strings causes vibration of a soundboard. The soundboard produces sound by resonance; specifically, the soundboard transmits the vibrations of the strings to the air. In addition, the body of the guitar forms a resonating chamber that further shapes and projects the sound. With electric guitars, transducers, known as pickups, convert string vibration to an electronic signal wherein the electronic signal is routed to an amplifier and then to a speaker.

One drawback of an electric guitar constructed with a hollow body is that uncontrolled resonance issues often result in feedback when the amplified sound waves from the speaker induce intensified resonant vibrations in the top plate or body of the guitar consequently increasing the amplitude of the original string vibration, typically at one or more of the resonant harmonic frequencies of the guitar body. Accordingly, in an attempt to control feedback problems occurring in an electric hollow body guitar, various guitar body structures were developed including solid-body guitars.

Although tending to be very resistant to feedback, one drawback of a solid-body electric guitar is that the characteristics of the sound produced generally lacks the resonant complexity of a hollow-body guitar. An advantage of a solid-body guitar is that a vibrating string can be allowed to sustain its vibration for a longer period of time since less of the string vibration energy is transferred into creating resonant vibration of the guitar body.

While typically having a solid body to prevent feedback problems, electric guitars may also have a semi-hollow guitar body. One advantage of a semi-hollow guitar body is the capability to produce complex resonant tones more characteristic of hollow-body guitars while still limiting susceptibility to feedback. One early historically significant example of a semi-hollow guitar is the Gibson ES-335 introduced in 1958 that featured a wooden block positioned in the center of the body and glued to both the top and bottom plates; see FIG. 8. For other more recent innovations see for example Baker, U.S. Pat. No. 6,459,024 disclosing a torsion brace connected to the body at three locations, the head portion, the heel portion and bridge support portion. In addition, Minakuchi, U.S. Pat. No. 6.646,189 discloses an electric guitar having a body having a center block extending from the head to the heel with a pair of side bridges extending from the center block to the frame.

Accordingly, the prior art discloses various body structures designed to control body structure vibration and correspondingly feedback occurring during amplified guitar use while still providing some measure of resonance. What is needed is a guitar body structure that better optimizes resonant characteristics, provides improved capability to sustain notes, and minimizes susceptibility to feedback while achieving a distinct guitar sound.

SUMMARY OF THE INVENTION

According to a preferred embodiment, the present invention provides a support structure for a musical instrument body for controlling sustainability and resonance of the instrument. The musical instrument includes a body having an annular member including a wall extending about an outer periphery of the body. A top plate and a bottom plate are attached to the annular member and cooperate with the annular member to form a chamber. The instrument includes a neck attached to the body with a plurality of strings attached on the ends thereof to the neck. The strings then extend across the body and over a bridge attached to the top plate with the opposite ends of the strings attached to the body.

A block is located in the chamber and attached to both the top plate and the bottom plate. A structural element attached to the annular member extends inward into the chamber and attaches to the block to support the block and to provide stiffness and support to the body. The structural element is spaced from the top plate and bottom plate to allow for controlled vibration of the respective top and bottom plates.

Accordingly, the structure of the present invention adds stiffness to the body to increase the sustainability of the instrument while limiting uncontrolled vibration, and thus uncontrolled feedback, thereof.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

The following description of the embodiments of the invention is merely exemplary in nature and is in no way intended to limit the invention, its application, or uses.

Figure 1:
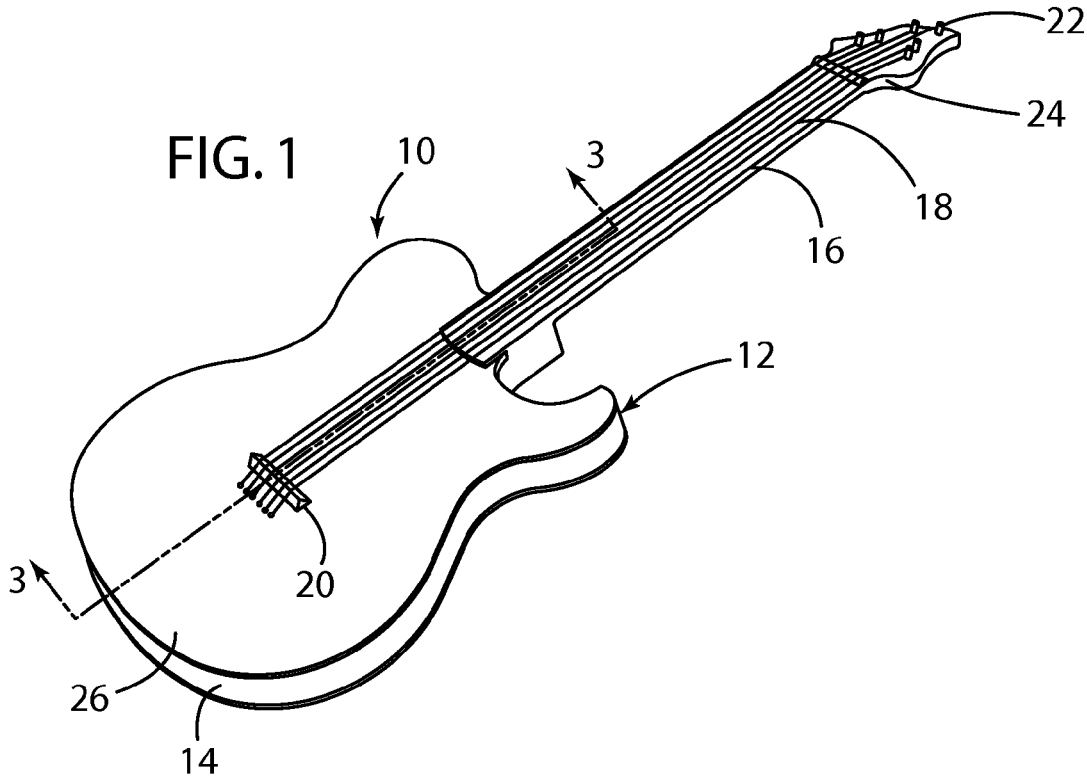
FIG. 1 is a perspective view of a string instrument having a body structure in accordance with a preferred embodiment of the present invention.
Figure 8:
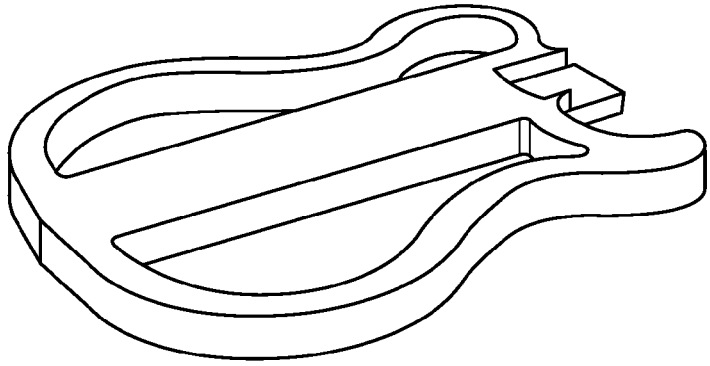
FIG. 8 PRIOR ART
FIG. 8 is a partial perspective view of a semi-hollow guitar body according to the prior art.
Figure 2:
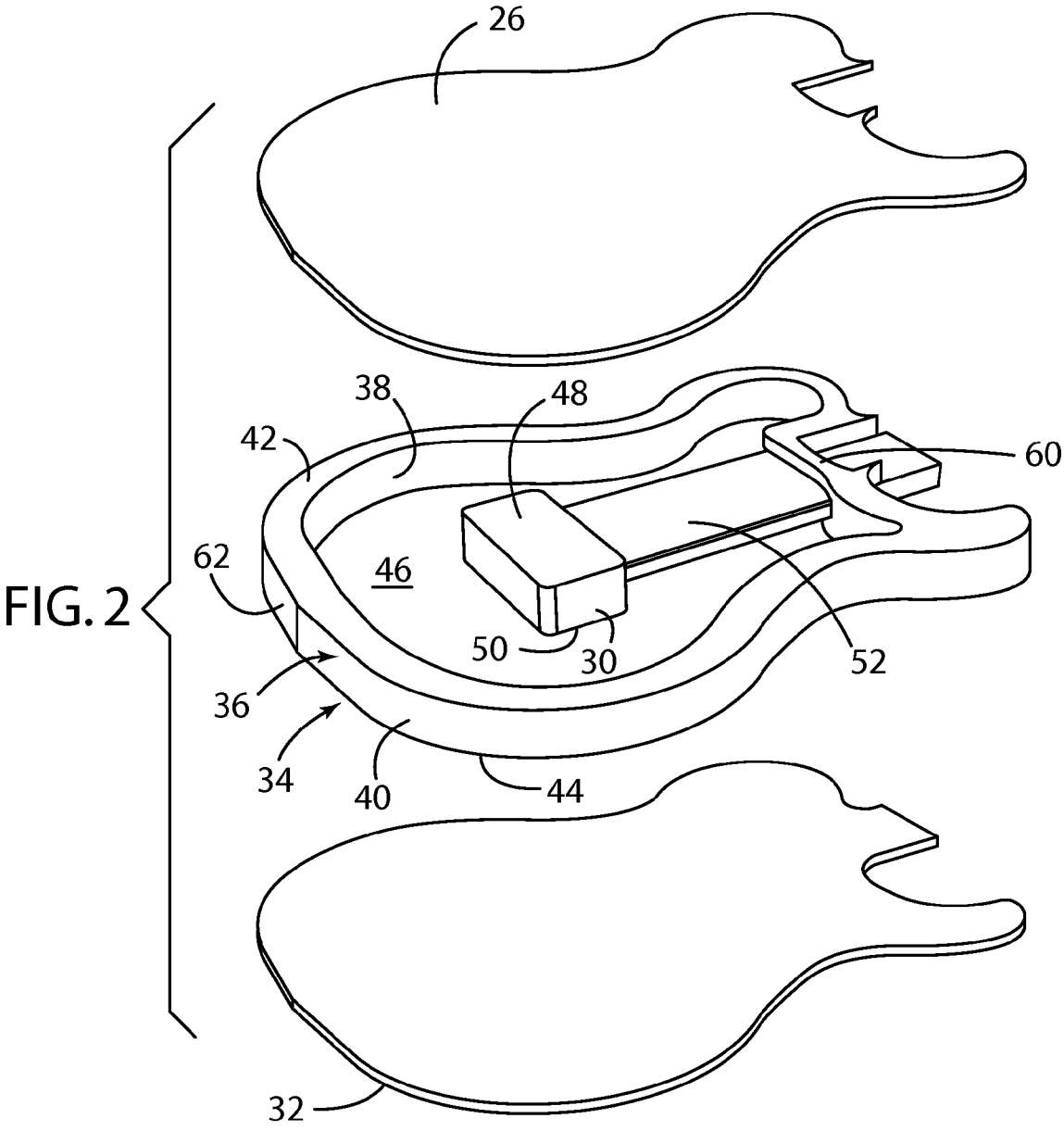
FIG. 2 is an exploded, partial perspective view illustrating the body structure of the string instrument of FIG. 1.
Figure 3:
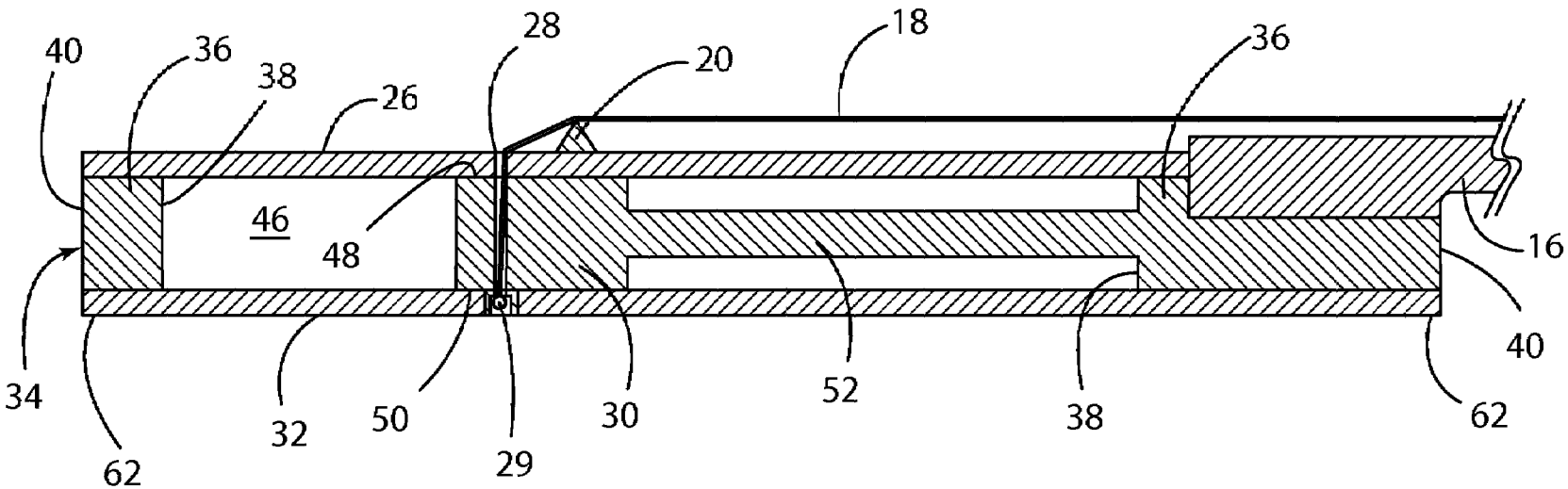
FIG. 3 is a cross-sectional view taken along line 3-3 of FIG. 1.

Turning to the drawings, FIGS. 1-3 illustrate a string instrument, seen generally at 10, according to the present invention. In accordance with the preferred embodiment, the string instrument 10 is a guitar 12. While shown used in the preferred embodiment with a guitar, the body structure according to the present invention can be used with a variety of other types of string instruments including various types of acoustic or electric guitars, bass guitars, ukuleles, mandolins or violins.

The guitar 12 generally includes a body 14, a neck 16 and a plurality of strings 18 attached to and extending from the neck 16 to the body 14. As shown, a plurality of pegs 22, rotatably supported in the head 24 of the neck 16, attach the ends of the strings 18 to the neck 16. As illustrated in FIG. 3, the opposite ends of the strings 18 extend over a bridge 20 and are fastened to the body 14. While the strings 18 are illustrated as extending through an aperture 28 located in the body 14, including the top plate 26 and block 30 and bottom of plate 32, and secured via a plurality of balls 29 each attached to an end of the strings 18 this is but one method of attaching the strings 18. Other methods include attaching the strings 18 to a bracket located on the heel or tail of the guitar or to a stop piece connected to either the top plate 26 or other portion of the guitar body.

FIG. 2 illustrates the various components of the body 14 prior to assembly and attachment of the neck 16, pegs 22, and strings 18. The body 14 includes a wall 34 located between the respective peripheral edges of the top plate 26 and the bottom plate 32. The wall 34 cooperates with the top plate 26 and bottom plate 32 to form a resonance chamber 46. As illustrated, the wall 34 includes a sidewall 36 having an inner side or surface 38, an outer side or surface 40, a top surface 42 and a bottom surface 44. The inner side or surface 38 defines the outer boundary of a resonance chamber 46 with the outer side or surface 40 forming the outer side of the body 14. The resonance chamber 46 is further bounded on one side by the top plate 26 and on the opposite side by the bottom plate 32 wherein the top plate 26 is attached to the top surface 42 of the sidewall 36 and the bottom plate 32 is attached bottom surface 44 of the sidewall 36. Accordingly, the size of the resonance chamber 46 depends in part on the height of the sidewall 36. While shown herein as having a constant height; i.e., the distance between the respective top and bottom plates 26, 32, the present invention contemplates varying the height of the sidewall 36 to vary the size of the resonance chamber 46. In addition, the present invention further contemplates varying the width, shape and size of the sidewall 36 to increase or decrease the size of the resonance chamber 46. In addition, as the width of the sidewall 36 increases, the size of the top and bottom surfaces 42, 44 correspondingly increases thus providing additional support to the peripheral edge of the top and bottom plates 26, 32 thereby increasing their rigidity and stiffness and correspondingly modifying the overall vibration thereof.

The block 30 includes a top surface 48 and a bottom surface 50. As illustrated, the block 30 is located within the resonance chamber 46 in a position spaced from the inner side or surface 38 of the sidewall 36. When the respective top 26 and bottom 32 plates are attached to the sidewall 36, they also connect to the top 48 and bottom 50 surfaces of the block 30. While illustrated herein as having a substantially rectangular shape with substantially flat or planar top 48 and bottom 50 surfaces, the block 30 can be formed in a multitude of exterior shapes having variable surface configurations. Further, the block 30 can be made of a plurality of different materials and may include a plurality of materials arranged in a layered relationship whether by the block 30 is formed of a laminate material. The block 30 may include a plurality of the apertures or openings therein; for example, the block 30 may have a honeycomb configuration or include either an open cell or a closed cell configuration all of which can be used to support the bridge 20 while controlling the vibration of the top and bottom plates 26, 32.

Accordingly, the block 30 contacts the top plate 26 and bottom plate 32 to increase the overall stiffness and rigidity of the body 14 and correspondingly increase the sustainability while at the same time limiting uncontrolled vibration of the bridge 20 secured to the top plate 26 at a position adjacent to or over the block 30. As disclosed, the bridge 20 is mounted to the top plate 26 over or on top of the block 30 wherein the strings 18 pass over the bridge 20 and through the block 30 and are anchored to the bottom plate 32 adjacent on the bottom surface 50 of the block 30. Supporting the bridge 20 in this manner provides additional stiffness and limits uncontrolled vibration of the bridge 20 thereby reducing uncontrolled feedback while still allowing for resonant vibration of the top and bottom plates 26, 32.

As illustrated, the block 30 supports both the top plate 26 and bottom plate 32 by in effect tying or coupling them together such that vibration of the top plate 26 resulting from vibration of the strings 18 is transferred to the bottom plate 32. Accordingly, the size and material of the block 30 controls the vibration and correspondingly the resonance of the body 14. Further, varying the surface area of the block 30 contacting the top plate 26 and bottom plate 32 will vary the vibration and corresponding resonance characteristics of the body 14. In addition, the surface area of the block 30 contacting the top plate 26 can differ from the surface area of the block 30 contacting the bottom plate 32. Once again, changing the size of respective surface areas supporting the top and bottom plates 26, 32 varies the vibration and corresponding resonance characteristics of the body 14 thus changing the overall sound created by the guitar 12.

A structural element or member 52 connected on one end thereof to the sidewall 36, or as broadly described the wall 34, extends inwardly into the resonance chamber 46. The structural member or element 52 engages the block 30 and supports the block 30 in a cantilever manner to further increase the stiffness and correspondingly the sustainability of the body 14 of the guitar 12. The structural member or element 52 is spaced from the top plate 26 and bottom plate 32. Accordingly, providing a gap or recess between the structural element 52 and an both the top and bottom plates 26, 32 provides additional support and rigidity to the guitar body 14 while allowing vibration of the top plate and bottom plates 26, 32 thereby providing an overall resonance to the string instrument 10.

While the structural element 52 extends longitudinally or along a longitudinal axis 54 extending through the guitar body 14 from the neck 16 to the block 30 this is but one embodiment. Additional structural elements or support members can extend inward from the inner side or surface 38 of the sidewall 36. Further, while shown herein a having a substantially rectangular longitudinal cross-section, depending upon the desired support and correspondingly the stiffness of the body the cross-section and the shape of the structural element 52 can be varied. For example, circular and square cross-sections along with other shapes may also be used. In addition, the cross-section can vary along the longitudinal axis. Further, the structural element 52 can be formed of a plurality of layers arranged to form a laminate.

The material forming the structural element 52 may vary with respect to the material forming the respective body 14 including the, sidewall 36 top plate 26, bottom plate 32 or block 30. For example, the block 30 and sidewall 36 may be made of a different material than the structural element 52. In addition, the block 30 can be formed about the structural element 52 or it may fit over the structural element 52. Depending upon manufacturing constraints or processes it may be easier to form the block 30 with an aperture complementary to the cross-sectional shape of the structural element 52 and slide the block 30 on the structural element 52. In addition, the block 30, structural element 52 and wall 34 may also be made as a single unitary or integral member.

Figure 7:
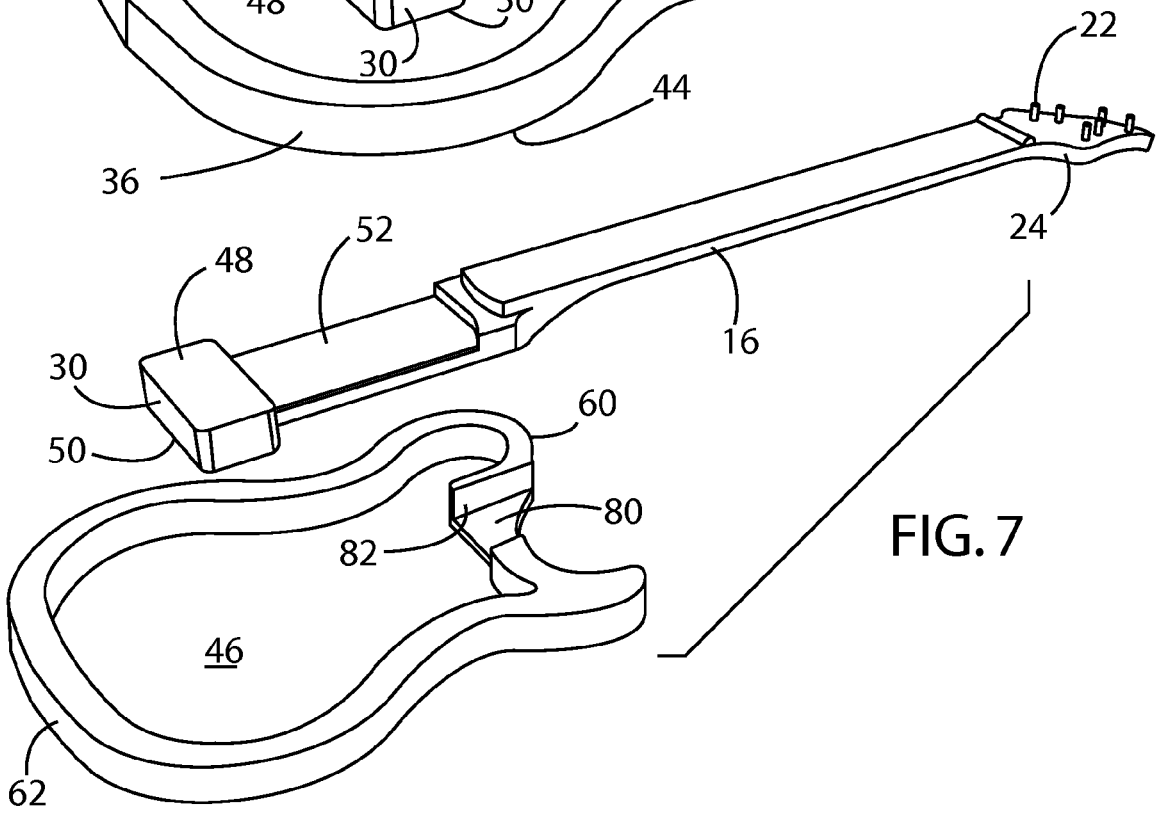
FIG. 7 is a partial perspective view of with portions removed for clarity, illustrating a body structure for a stringed instrument according to an alternative embodiment of the present invention.

Thus, the structural element 52 in concert with the block 30 forms a resonance control member whereby adjusting the size, shape and material forming the structural element 52 and the size, shape and material forming the block 30 changes the overall resonance and sustainability of the body 14. Thus, the present invention provides a body 14 having a block 30 and structural element 52 combination configured to modify or change the resonant properties of the body 14. For example, as the structural element 52 cooperates with the block 30 to increase the overall stiffness of the body 14, it reduces or controls vibration of the top and bottom plates 26, 32 thus reducing susceptibility to uncontrolled feedback. Further, increasing the stiffness will increase the sustainability. In addition, the structural element 52 and the block 30 cooperate with the rest of the body 14, the neck 16 and the head 22 to form a structure extending between the two ends of the string 18. Depending upon the particular embodiment of the present invention, the structural element 52 and block 30 can be a one-piece design, a two-piece design or may fit into and form a portion of the wall 36. For example, as illustrated in FIG. 7 the structural element 52 and block 30 form a continuous structure extending from the head 24 of the neck 16 to the block 30. Thus, the present invention enables the designer of a string instrument to vary the body structure and achieve a desired sound from the instrument. Accordingly, the term one-piece as used herein refers to a single piece component or part, not to parts combined. For example, the structural element and the block can be formed of a single piece of material in which case they would be of one-piece design. Should they be formed of two separate pieces and placed or connected together they would be a two-piece design.

Figure 4:
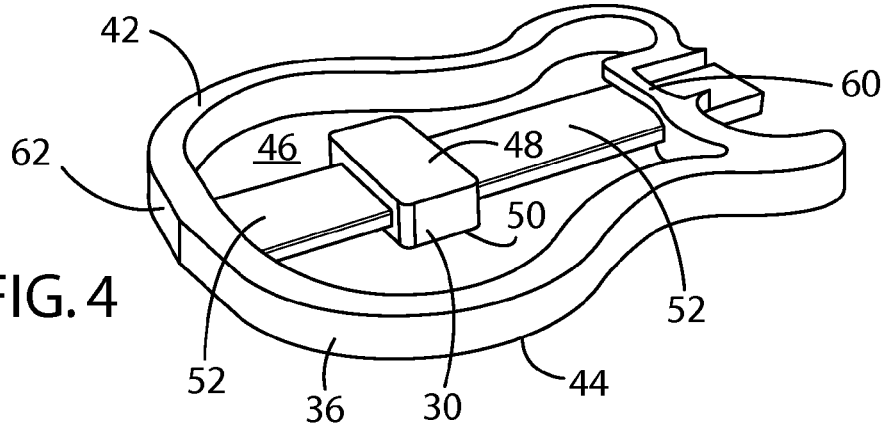
FIG. 4 is a partial, perspective view, with portions removed for clarity, illustrating a body structure for a stringed instrument according to an alternative embodiment of the present invention.

FIG. 4 illustrates an alternative embodiment of the present invention includes a structural element 52 connected to the inner side surface 38 of the wall 34. The structural element 52 extends longitudinally from the head 62 to the heel 62 of the wall 34. Accordingly, the structural element 52 supports the block 30 on both sides, as opposed to the single or cantilever type support as shown in FIG. 2. As with the embodiment shown in FIG. 2, the structural element 52 while engaging the wall 34 at both the head 60 and heel 62 portions is spaced from the top plate 26 and bottom plate 32. Accordingly, the block 30 contacts both the top plate 26 and bottom plate 32 while the structural element 52 provides support to the block 30. Again, by spacing the structural element from the top plate 26 and bottom plate 32 the respective top and bottom plates 26, 32 can vibrate to produce a distinctive and pre-selected sound.

Figure 5:
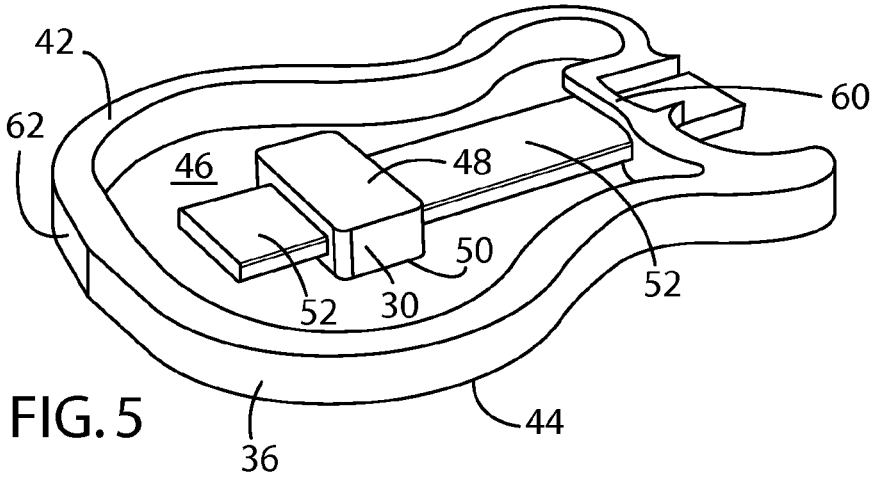
FIG. 5 is a partial, perspective view, with portions removed for clarity, illustrating a body structure for a stringed instrument according to an alternative embodiment of the present invention.

FIG. 5 illustrates a further embodiment of the present invention wherein the structural element 52 extends past the block 30 not all the way to the heel 62 of the sidewall 36. Extending the structural element 52 past the block 30 adds mass without additional stiffness. Thus, the resonant frequency can be adjusted by either changing the oscillating mass or the stiffness thereof. Adding mass without changing the stiffness lowers the resonant frequency.

Figure 6:
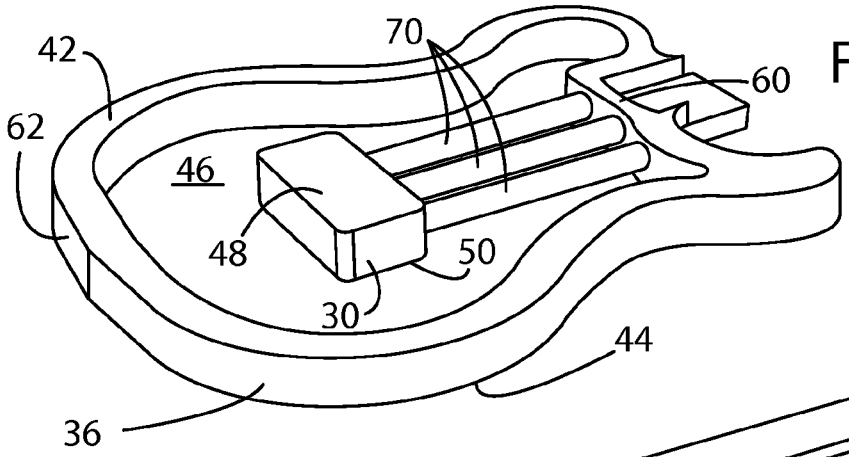
FIG. 6 is a partial, perspective view with portions removed for clarity, illustrating a body structure for a stringed instrument according to an alternative embodiment of the present invention.

FIG. 6 illustrates another embodiment of the present invention wherein a plurality of parallel rods 70 extending between the head 60 and the block 30 form the structural element 52. While each of the rods 70 are shown as parallel and identical, this is for illustration purposes only, the invention contemplates varying the location along with the size, shape and material of each rod 70 independent of the adjacent rods 70. Once again, the overall resonance of the body 14 depends upon the size, shape and material forming the rods.

FIG. 7 illustrates a further embodiment of the present invention wherein the neck 16, structural element 52 and block 30 are formed as a continuous member whereby a continuous structure extends between both ends of the string 18 or between the bridge 20 and the head 24 of the neck 16. As illustrated, the continuous structure is seated in a groove or slot 80 located in the head 60 of the sidewall 36. While shown as a groove 80 in the sidewall 36, the invention contemplates forming an opening or gap in the sidewall 36 at the head 60 whereby the sidewall 36 is not continuous. Accordingly, the respective ends or side surfaces 82 of the sidewall 36 would connect to the continuous structure formed of the neck 16, structural element 52 and block 30. Further, while shown as a two-piece design; i.e., a separate neck 16 connected to the sidewall 36, it is contemplated that the entire assembly could be made as one-piece, for example the neck 16, sidewall 36, structural element 52 and block 30 could all be cut from a single block of material.

Thus, the present invention provides an apparatus for creating a musical instrument, such as a string instrument having a particular and distinctive sound, by varying the structure of the body 14 such that a resonance chamber 46 formed by the body is controlled by a block 30 attached above the top plate 26 and bottom plate 32 along with a structural element 52 spaced from the respective top plate 26 and bottom plate 32. The present invention provides an apparatus that controls the vibration of the respective top and bottom plates 26, 32 and thereby controls the resonance and sustainability of the sound created when plucking or strumming a string attached to the instrument. It should be understood that the present invention enables adjustment to the resonant characteristics of the musical instrument with very little affect on the external appearance and the manufacturing process. The present invention provides a structure whereby adjustments to mass, geometry and material selection of the internal structure are easily made in order to tune the resonant characteristics of the entire instrument.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. A structure forming a portion of a musical instrument body, said body including a sidewall, a top plate and a bottom plate, said top plate and said bottom plate cooperating with said sidewall and defining a chamber, the structure comprising:

a block, having an upper surface and a lower surface, located in said chamber in a position spaced from said sidewall, said upper surface fixed to said top plate and said lower surface fixed to said bottom plate; and a structural element extending from said sidewall and fixed to said block, said structural element spaced from said top plate and said bottom plate.

2. A structure as set forth in claim 1 wherein at least one of said block and said structural element having a cross-section that varies along a longitudinal axis thereof.

3. A structure as set forth in claim 1 wherein said top surface of said block and said bottom surface of said block each have a defined surface area, the surface area of said top surface of said block being different than the surface area of said bottom surface of said block.

4. A structure as set forth in claim 1 wherein said block and said structural element are a single piece.

5. A structure as set forth in claim 1 wherein said structure is formed of a plurality of materials.

6. A structure as set forth in claim 1 wherein a plurality of structural elements extend between said annular member and said block.

7. A structure as set forth in claim 1 wherein at least one of said block and said structural element include a plurality of apertures.

8. A musical instrument comprising:

a body including a sidewall, a top plate and a bottom plate, said top plate and said bottom plate cooperating with said sidewall and defining a chamber;

a neck attached to said body;

a bridge attached to said body;

a plurality of strings attached to said neck, extending across said bridge and attached to said body; and a resonance control member connected to said sidewall and extending into said chamber, said resonance control member including a block and a structural element, said block located in said chamber and spaced from said sidewall , said block having an upper surface contacting said top plate and a lower surface contacting said bottom plate and said structural element extending between and contacting said block and said sidewall, said structural element spaced from said top plate and said bottom plate.

9. A musical instrument as set forth in claim 8 wherein said resonance control member and said sidewall are a single, one-piece member.

10. A musical instrument as set forth in claim 8 wherein said resonance control member and said neck are a single, one-piece member.

11. A musical instrument as set forth in claim 8 wherein said structural element has a first end and a second end, said structural element extends across said chamber whereby said first end contacts said sidewall at a first position and said second end contacts annular member at a second position, with said second position being different from said first position.

12. A musical instrument as set forth in claim 8 wherein said structural element has a first end and a second end, said structural element extending into said chamber whereby said first end contacts said sidewall and said second end is spaced from said sidewall.

13. A musical instrument as set forth in claim 8 wherein said structural element has a first end and a second end, said structural element extending into said chamber whereby said first end contacts said sidewall, said second end is spaced from said sidewall, and said block is located on said structural element between said first end and said second end of said structural element.

14. A musical instrument as set forth in claim 8 wherein said structural element has a first end and a second end, said structural element extending into said chamber whereby said first end contacts said sidewall, said second end is spaced from said sidewall, and said block is located on said second end of said structural element.

15. A musical instrument as set forth in claim 8 wherein said structural element has a longitudinal axis and said body has a longitudinal axis extending from a head to a heel, the longitudinal axis of said structural element coinciding with the longitudinal axis of said body; and said neck having a longitudinal axis, said longitudinal axis of said neck coinciding with said the longitudinal axis of said structural element.

16. A musical instrument comprising:

a body including a wall having an inner surface, an outer surface, a top surface and a bottom surface;

a top plate, said top plate attached to said top surface of said wall;

a bottom plate, said bottom plate attached to said bottom surface of said wall; said wall cooperating with said top plate and said bottom plate to form a chamber, said chamber having an outer periphery defined by said inner surface of said wall;

a neck attached to said body;

a bridge attached to said body;

a plurality of strings attached on a first end to said neck, extending across said bridge, and attached on a second end to said body;

a block, said block having a top surface and a bottom surface and at least one side wall, said top surface contacting said top plate and said bottom surface contacting said bottom plate wherein said block is disposed in said chamber and spaced from said inner surface of said wall; and a structural element attached to and extending inward into said chamber from said wall and said structural element contacting and supporting said block, said structural element spaced from said top plate and said bottom plate.

17. A musical instrument as set forth in claim 16 including said body having a plurality of apertures extending through said top surface, said block and said bottom surface; and one end of said plurality of strings extending through said plurality of apertures and secured at said bottom plate.

18. A musical instrument as set forth in claim 16 wherein said second end of said plurality of strings are attached to said top plate of said body.

19. A musical instrument as set forth in claim 16 wherein said second end of said plurality of strings are attached to said wall of said body.

20. A musical instrument as set forth in claim 16 wherein said second end of said plurality of strings are attached to a pitch bending device, said pitch bending device attached to said body.

* * * * *